US009157338B2

(12) United States Patent
Nunami et al.

(10) Patent No.: US 9,157,338 B2
(45) Date of Patent: Oct. 13, 2015

(54) LASH ADJUSTER

(71) Applicant: AISIN SEIKI KABUSHIKI KAISHA, Kariya-shi (JP)

(72) Inventors: Koji Nunami, Kariya (JP); Hisashi Ono, Kariya (JP); Yuki Nishida, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/374,299

(22) PCT Filed: Jan. 31, 2013

(86) PCT No.: PCT/JP2013/052201
§ 371 (c)(1),
(2) Date: Jul. 24, 2014

(87) PCT Pub. No.: WO2013/118634
PCT Pub. Date: Aug. 15, 2013

(65) Prior Publication Data

US 2014/0366827 A1 Dec. 18, 2014

(30) Foreign Application Priority Data

Feb. 10, 2012 (JP) ..... 2012-027686

(51) Int. Cl.
*F01L 1/14* (2006.01)
*F01L 1/18* (2006.01)
(Continued)

(52) U.S. Cl.
CPC ..... *F01L 1/185* (2013.01); *F01L 1/2411* (2013.01); *F01L 13/0021* (2013.01); *F01L 13/0026* (2013.01); *F01L 2001/2433* (2013.01); *F01L 2001/2444* (2013.01); *F01L 2105/00* (2013.01)

(58) Field of Classification Search
CPC .. F01L 1/185; F01L 1/2411; F01L 2001/2433
USPC ..... 123/90.45, 90.46, 90.52, 90.55
See application file for complete search history.

(56) References Cited

U.S. PATENT DOCUMENTS 2,681,644 A 6/1954 Purchas, Jr. et al.
2,742,030 A 4/1956 Gleeson
(Continued)

FOREIGN PATENT DOCUMENTS

DE 28 09 055 A1 9/1978
JP 54-121317 A 9/1979
(Continued)

OTHER PUBLICATIONS

International Search Report (PCT/ISA/210) mailed on Apr. 9, 2013, by the Japanese Patent Office as the International Searching Authority for International Application No. PCT/JP2013/052201.
(Continued)

*Primary Examiner* — Ching Chang
(74) *Attorney, Agent, or Firm* — Buchanan Ingersoll & Rooney PC

(57) ABSTRACT

A lash adjuster is configured that reduces the impact at the time when a pressure force is exerted on a pressure-receiving effector, and reliably opens a valve by the necessary amount. This lash adjuster includes, in a relatively movable manner, the pressure-receiving effector that receives the pressure force and a relay effector that performs an operation of opening an intake valve, a pressure receiving-side damper space is formed at an insertion portion thereof, and an orifice portion is formed that suppresses an outflow of oil in the pressure receiving-side damper space when the pressure-receiving effector and the relay effector move in approaching directions. An abutting portion is formed that directly transmits the pressure force of the pressure-receiving effector to the relay effector when the pressure-receiving effector and the relay effector approach each other.

5 Claims, 11 Drawing Sheets

(51) Int. Cl.
*F01L 13/00* (2006.01)
*F01L 1/24* (2006.01)

(56) References Cited

U.S. PATENT DOCUMENTS

| | | | | |
|---|---|---|---|---|
| 4,133,332 | A | 1/1979 | Benson et al. | |
| 4,191,142 | A | 3/1980 | Kodama | |
| 5,451,029 | A | 9/1995 | Krüger | |
| 7,845,327 | B2 * | 12/2010 | Tallio et al. ..... | 123/90.52 |

FOREIGN PATENT DOCUMENTS

| | | | |
|---|---|---|---|
| JP | 55-146210 | A | 11/1980 |
| JP | 56-50207 | A | 5/1981 |
| JP | 61-215410 | A | 9/1986 |
| JP | 4-224212 | A | 8/1992 |
| JP | 6-193411 | A | 7/1994 |
| JP | 2006-017114 | A | 1/2006 |
| JP | 2009-008050 | A | 1/2009 |

OTHER PUBLICATIONS

Written Opinion (PCT/ISA/237) mailed on Apr. 9, 2013, by the Japanese Patent Office as the International Searching Authority for International Application No. PCT/JP2013/052201.

Notification of Transmittal of Translation of the International Preliminary Report on Patentability (Forms PCT/IB/338 and PCT/IB/373) and the Written Opinion of the international Searching Authority (Form PCT/ISA/237) issued on Aug. 21, 2014, by the International Bureau of WIPO in corresponding International Application No. PCT/JP2013/052201. (7 pages).

U.S. Appl. No. 14/377,692, filed Aug. 8, 2014, Aisin Seiki Kabushiki Kaisha.

Extended European Search Report issued on Jun. 12, 2015, by the European Patent Office in corresponding European Patent Application No. 13747000.1-1606. (4 pages).

* cited by examiner

LASH ADJUSTER

TECHNICAL FIELD

The present invention relates to a lash adjuster, and more particularly to a technique for reducing noise at the time of an operation of a valve.

BACKGROUND ART

PTL 1 discloses, as a lash adjuster configured as mentioned above, a configuration in which a plunger is slidably fitted into a tubular body at an end portion of a rocker arm, a high-pressure chamber that operates the plunger in a projecting direction by oil being supplied to the high-pressure chamber is formed within the body, and a check ball that opens and closes a small hole that is in communication with the high-pressure chamber is provided.

In PTL 1, the plunger is caused to project and abut against the upper end of a valve stem by the oil being supplied to the high-pressure chamber so as to eliminate a gap, and thus generation of a knocking sound is suppressed. When a pressure force from the rocker arm is transmitted to the valve stem, the check ball suppresses an outflow of the oil from the high-pressure chamber, and therefore opening of the valve is realized.

CITATION LIST

Patent Literature

PTL 1: JP H6-193411A

SUMMARY OF INVENTION

Technical Problem

Even with a configuration in which a gap between a plunger and a valve stem is eliminated by causing the plunger to project using an oil pressure as disclosed in PTL 1, the plunger cannot follow operations of a rocker arm due to the oil pressure since the rocker arm operates at a high speed, and it is also conceivable that an impact is caused when the plunger of the rocker arm comes into contact with the valve stem. If the impact is thus caused, an impact sound is caused, which leads to generation of noise.

Furthermore, with a configuration in which a flow of oil is blocked using a check ball at a timing of a pressure force of a rocker arm being exerted on a valve stem, so as to exert the pressure force on the valve, as disclosed in PTL 1, the valve cannot be opened by the necessary amount in the case where the oil leaks out at the position of the check ball, which leads to an inconvenient insufficiency of the opening amount.

Here, a valve control mechanism is assumed in which the pivoting amount (pivot angle) of a rocker arm at the time when a camshaft rotates once is changed by means of an operation of changing the distance between the fulcrum position of the rocker arm and the position at which a cam of the camshaft comes into contact with it, or the like. In this valve control mechanism, the amount of lifting of an intake valve can be changed, and adjustment of the air intake amount is realized. However, since the pivoting amount of the rocker arm changes, an operation of accurately reflecting the change of the pivoting amount as the valve opening amount while suppressing the impact at the time of pressing is desired.

An object of the present invention is to reasonably configure a lash adjuster that reduces the impact at the time when a pressure force is exerted on a pressure-receiving effector, and reliably opens a valve by the necessary amount.

Solution to Problem

A feature of the present invention lies in including: a pressure-receiving effector that moves back and forth in an operating direction of a valve, due to a pressure force; a relay effector that can relatively move with respect to the pressure-receiving effector while the relay effector and the pressure-receiving effector are in an inserted relationship with each other, and that abuts against the valve and moves back and forth in the operating direction; an intermediate spring that abuts against the pressure-receiving effector and the relay effector and biases the pressure-receiving effector and the relay effector in separate directions; and a sleeve member into which the pressure-receiving effector and the relay effector are slidably inserted, and that is provided with an oil supply passage for supplying a working fluid to the pressure-receiving effector and the relay effector, wherein a pressure receiving-side damper space whose volume decreases as the pressure-receiving effector is pressed in due to the pressure force and the distance between the pressure-receiving effector and the relay effector is shortened, and an orifice portion that suppresses an outflow of the working fluid from the pressure receiving-side damper space are formed between the pressure-receiving effector and the relay effector.

With this configuration, since the pressure-receiving effector and the relay effector relatively move in relatively separate directions due to a biasing force of the intermediate spring, a state can be maintained where the pressure-receiving effector is caused to project and come into contact with driving mechanisms such as a rocker arm and a cam. Furthermore, when a pressure force is exerted on the pressure-receiving effector from the driving mechanisms such as the rocker arm and the cam, the pressure force exerted on the pressure-receiving effector is exerted on the relay effector via the working fluid in the pressure receiving-side damper space, and is exerted further in the direction of opening the valve. When the pressure force is exerted on the valve from the relay effector, part of the pressure force is released when the pressure-receiving effector approaches the relay effector, as a result of the working fluid in the pressure receiving-side damper space flowing out of the orifice portion, and the impact can be absorbed. Thereafter, as a result of a state being reached where the pressure-receiving effector and the relay effector abut against each other, the valve can also be opened by exerting the pressure force exerted on the pressure-receiving effector directly to the valve from the relay effector.

In particular, with this configuration, when the pressure force is exerted on the valve from the rocker arm, the impact is always absorbed due to the effect of the orifice portion and the working fluid in the pressure receiving-side damper space, and therefore an impact sound can be reduced even if the rocker arm operates at a high speed.

Accordingly, a lash adjuster is configured that reduces the impact at the time when a pressure force is exerted on the pressure-receiving effector, and reliably opens the valve by the necessary amount.

In the present invention, it is preferable that a restoring-side damper space whose volume decreases as the relay effector is pressed back by the valve is formed so as to span between the relay effector and the sleeve member.

With this configuration, when the relay effector is displaced with an operation of the valve in the closing direction after the valve is opened, the working fluid in the restoring-side damper space is compressed and this working fluid flows out via the orifice portion. A rapid operation of the valve is thereby suppressed, and the impact at the time of reaching a closed state is suppressed.

In the present invention, the restoring-side damper space may be formed in an area that is continuous with the pressure receiving-side damper space, a control body that is displaced in a direction of closing the pressure receiving-side damper space when the pressure-receiving effector is displaced in a direction of approaching the relay effector may be formed in at least one of the pressure-receiving effector and the relay effector, and the orifice portion may be formed between the control body and an inner wall of the pressure receiving-side damper space.

With this configuration, since a state where the orifice portion is caused to function is reached by the control member being displaced, the orifice portion does not function at an early stage of displacement of the pressure-receiving effector due to a pressure force being exerted thereon, and relatively high-speed displacement is possible. Next, the more the control member approaches the pressure receiving-side damper space, the more the orifice portion functions, and therefore the flow of the working fluid flowing out of the pressure receiving-side damper space is gradually suppressed. For this reason, the pressure force transmitted from the damper space to the relay effector is gradually increased, and impact absorption is realized. That is to say, since the operation is suppressed in an area in which the impact needs to be absorbed, a delay of a valve operation timing is not caused, and energy is not wastefully consumed, as compared with a configuration in which operations in all areas are suppressed when the rocker arm operates in a pressing direction.

In the present invention, it is preferable that the pressure receiving-side damper space and the restoring-side damper space are aligned in a radial direction.

With this configuration, a reduction in the size of the lash adjuster can be achieved by shortening the axial length thereof, as compared with a configuration in which the pressure receiving-side damper space and the restoring-side damper space are disposed in an axial direction.

In the present invention, it is preferable that the restoring-side damper space is formed by the relay effector and the sleeve member.

As a result of forming the restoring-side damper space using two components, namely the relay effector and the sleeve member, the shape of the restoring-side damper space is defined by the shape of the two components. Accordingly, the shape and performance of the restoring-side damper space can be stabilized only by managing the dimensions of the relay effector and the sleeve member, and the lash adjuster having an excellent impact-absorbing function can be easily obtained.

In the present invention, it is preferable that the oil supply passage includes a first supply and discharge passage and a second supply and discharge passage, and the working fluid is supplied to the restoring-side damper space simultaneously from the first supply and discharge passage and the second supply and discharge passage.

With this configuration, properties of supply of the working fluid to the restoring-side damper space can be improved, and therefore the impact-absorbing function of the restoring-side damper space can be stably accomplished.

DESCRIPTION OF EMBODIMENTS

1. First Embodiment

Hereinafter, a first embodiment of the present invention will be described based on the drawings.

Basic Configuration

Figure 1:
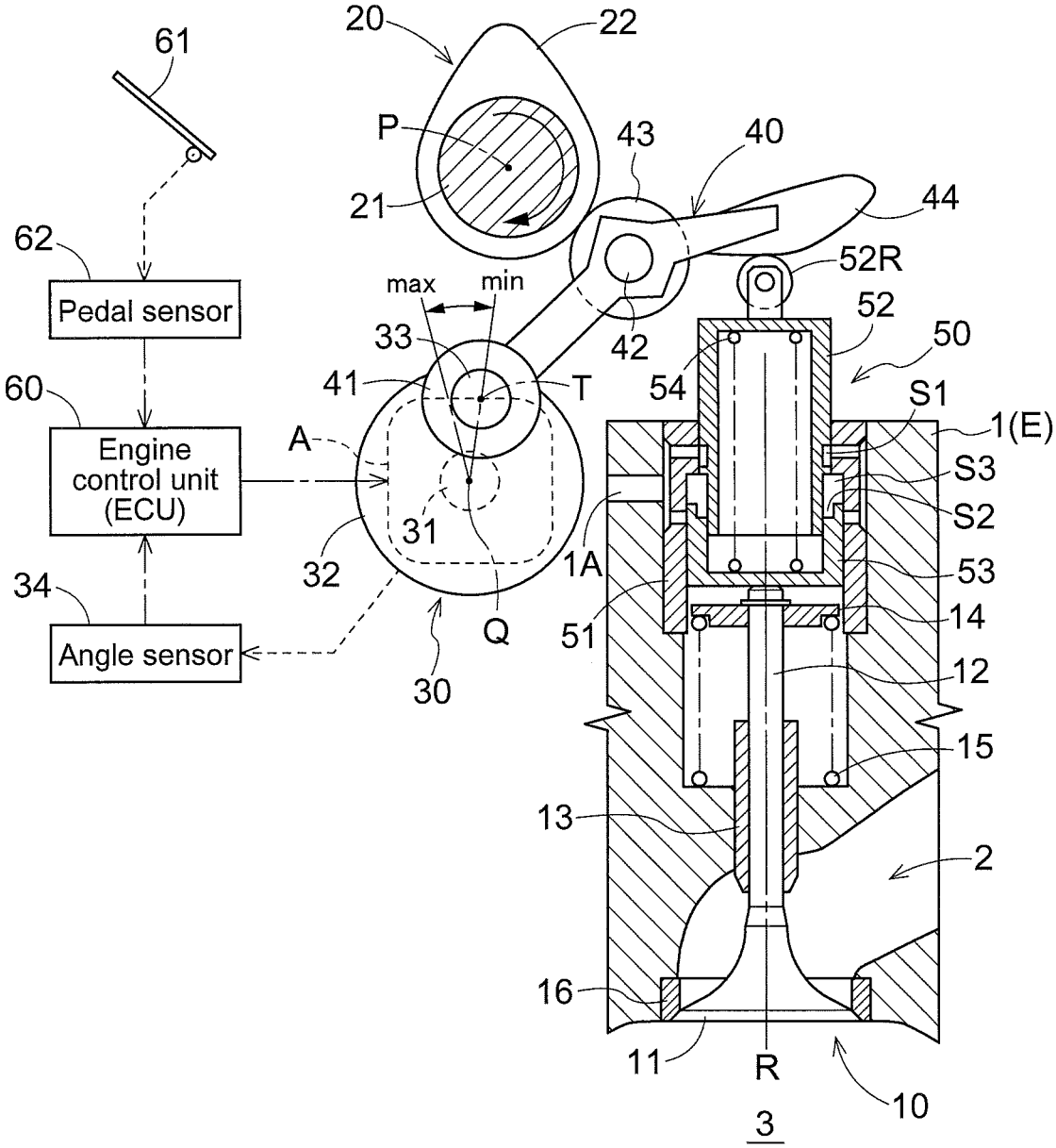
FIG. 1 is a diagram showing a configuration of an engine valve control mechanism.

FIG. 1 shows a valve control mechanism for a four-stroke cycle engine E equipped with an intake valve 10 of the engine E, a camshaft 20, a shift unit 30, a rocker arm 40, a lash adjuster 50, and an engine control unit 60 serving as a control unit (ECU) that controls the lift amount of the intake valve 10.

The valve control mechanism is configured such that a cam portion 22 of the camshaft 20 abuts against an intermediate roller 43 at an intermediate position on the rocker arm 40 in the longitudinal direction thereof, and the rocker arm 40 thereby pivots around a pivot axis T. In the valve control mechanism, an abutting body 44 at a pivot end of the rocker arm 40 is disposed close to the lash adjuster 50, and an operation of opening the intake valve 10 is performed by transmitting, when a pressure force is exerted from the abutting body 44 with a pivot of the rocker arm 40, the pressure force from the lash adjuster 50 to the intake valve 10, while absorbing the impact.

In this valve control mechanism, a control member 32 of the shift unit 30 is rotatably supported around a control axis Q, and a base end portion of the rocker arm 40 is pivotably supported around the pivot axis T by an eccentric support portion 33 that is eccentric from the control axis Q. The valve control mechanism shifts the rocker arm 40 in the longitudinal direction by the control member 32 rotating due to being driven by an actuator A, continuously adjusts the lift amount of the intake valve 10, and also changes the air intake timing in conjunction with this adjustment. Note that a cam axis P of the camshaft 20, the control axis Q, and the pivot axis T are set in a mutually parallel orientation.

A description will be given later of a specific operation mode, in which, while the camshaft 20 rotates once, the lift amount is changed due to a change of an operation stroke exerted on the intake valve 10 from the camshaft 20, and the opening timing and the opening duration time of the intake valve 10 are changed due to a change of an area (operation angle) in which the pressure force is exerted on the intake valve 10 from the camshaft 20. The operation angle indicates an area at the rotation angle of the camshaft 20 when the intake valve 10 is in an opened state, and the timing (rotation angle of the camshaft 20) at which the lift amount is largest is also necessarily changed due to the change of this operation angle. Note that a cam axis P of the camshaft 20, the control axis Q, and the pivot axis T are set in a mutually parallel orientation.

The engine control unit 60 detects the amount of a stepping operation on an accelerator pedal 61 (an example of an accelerator operation tool) of a vehicle, using a pedal sensor 62, shifts the rocker arm 40 in the longitudinal direction by controlling the actuator A based on a detected value, and adjusts the pivot amount of the rocker arm 40 at the time when the cam portion 22 of the camshaft 20 abuts against the intermediate roller 43. With this adjustment, the lift amount of the intake valve 10 is set to a target value, and simultaneously, the air intake amount and the air intake timing of a combustion chamber 3 of the engine E are controlled by setting the air intake timing, and consequently the control of the rotational speed of the engine E is realized.

The valve control mechanism may be provided not only for the above-described intake valve 10 but also for an exhaust valve, and may be provided for both the intake valve and the exhaust valve. The details of the valve control mechanism will be described below.

Intake Valve

The intake valve 10 has a shape obtained by integrally forming a valve head 11 that expands in an umbrella shape on the lower end side and a shaft-like valve stem 12 that is continuous with the valve head 11. The intake valve 10 is supported in a mode in which the valve stem 12 is slidably inserted into a valve guide 13 provided in a cylinder head 1.

A compression coil-type valve spring 15 is provided between a stopper 14 at the upper end of the valve stem 12 and the cylinder head 1, and the intake valve 10 is maintained in a closed state by the valve head 11 abutting against a valve seat 16 at a boundary position between an intake passage 2 and the combustion chamber 3 due to a biasing force of the valve spring 15.

Camshaft and Shift Unit

The camshaft 20 includes a camshaft portion 21 and the cam portion 22 projecting from the outer circumference thereof. The camshaft portion 21 is supported by the cylinder head 1 so as to rotate around the cam axis P due to a driving force transmitted from a crankshaft (not shown) by a timing chain (not shown).

This valve control mechanism may include a variable valve timing system that changes a relative rotational phase of the cam portion 22 with respect to a driving system constituted by the timing chain and the camshaft 20. An exemplary variable valve timing system is constituted by a driving-side rotational member that rotates integrally with a sprocket around which the timing chain is wound, a driven-side rotational member that rotates integrally with the camshaft 20, and an actuator that changes a relative rotation angle therebetween.

With the variable valve timing system, the air intake timing can be optimally set based on the rotational speed of the engine E, the load exerted on the engine E, and the like, and for example, the torque at the time of low-speed running can be increased, and the startability of the engine E can be improved. Note that the variable valve timing system may be provided in an exhaust camshaft, and both a hydraulic actuator and an electric actuator can be used.

The shift unit 30 includes the eccentric support portion 33 that rotatably supports the disk-like control member 32 around the axis (control axis Q) of a shaft body 31 supported by the cylinder head 1, and that has a shaft shape in a parallel orientation with respect to the control axis Q in an outer-circumferential portion of the control member 32. This shift unit 30 includes the electric motor-type actuator A that rotates the control member 32 with respect to the shaft body 31, and includes an angle sensor 34 that detects the rotation amount of the control member 32 with respect to the shaft body 31.

Note that the actuator A in the shift unit 30 may be a hydraulic actuator, and in the case of using the hydraulic actuator, the same configuration as that of an actuator used in a hydraulic variable valve timing system can be used.

Rocker Arm

The rocker arm 40 has, at the base end portion thereof, a ring-like loosely-fitted portion 41 that is loosely fitted to the eccentric support portion 33, rotatably supports, at an intermediate position in the longitudinal direction, the intermediate roller 43 around a spindle 42 in a parallel orientation with respect to the cam axis P, and has the abutting body 44 on the pivot end side that is opposite to the base end portion.

The loosely-fitted portion 41 of the rocker arm 40 is rotatably supported with respect to the eccentric support portion 33 of the shift unit 30, and the rocker arm 40 is thereby supported around the pivot axis T. The cam portion 22 of the camshaft 20 abuts against the intermediate roller 43, and the abutting body 44 thereby pivots so as to be displaced downward. With this pivot, the pressure force from the abutting body 44 is transmitted to the lash adjuster 50 and further to the intake valve 10, and the intake valve 10 is opened.

The abutting body 44 has an arc-shaped abutting face that moderately projects downward, and is configured so as not to move, upward or downward, the position where the abutting body 44 abuts against the lash adjuster 50 even when the rocker arm 40 shifts in the longitudinal direction.

Lash Adjuster

Figure 8:
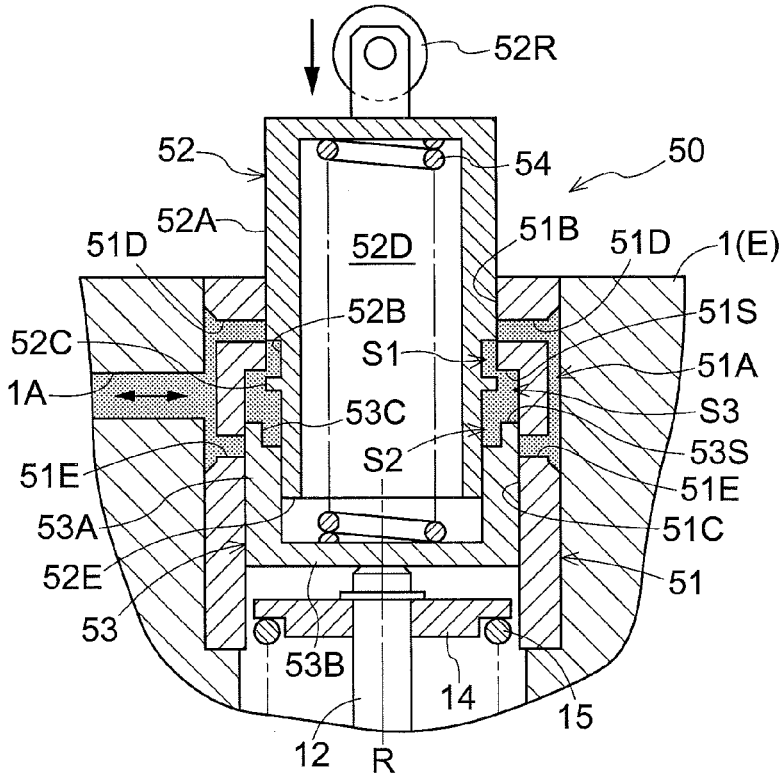
FIG. 8 is a cross-sectional view of the lash adjuster according to a first embodiment, immediately after a pressure force is exerted on a pressure-receiving effector.

As shown in FIG. 8, the lash adjuster 50 has a configuration in which a pressure-receiving effector 52 and a relay effector 53 are inserted in a slidable state and in a relatively movable manner, into a sleeve member 51 that is fitted and fixed to the cylinder head 1 serving as a fixture system. The sleeve member 51, the pressure-receiving effector 52, and the relay effector 53 are disposed coaxially with a valve axis R of the valve stem 12 of the intake valve 10, and the pressure-receiving effector 52 and the relay effector 53 are supported so as to be able to move back and forth along the valve axis R. A fluid space S1, a pressure receiving-side damper space S2, and a restoring-side damper space S3 are formed. The lash adjuster 50 also includes an oil passage system that supplies and discharges oil serving as a working fluid to and from the aforementioned spaces. While the lash adjuster 50 works regardless of the orientation thereof, the positional relationship, configurations, and the like will be described based on the orientation shown in FIG. 8.

The sleeve member 51 is formed in a ring shape as a whole, and a storage space 51A that stores the oil is formed in an outer-circumferential portion of the sleeve member 51 as a result of the diameter of the outer-circumferential portion thereof being partially reduced. An oil passage 1A for supplying the oil from a hydraulic pump (not shown) to the storage space 51A is formed in the cylinder head 1. A small diameter portion 51B is formed on the upper side (opposite side to the intake valve 10) within the sleeve member 51, and a large diameter portion 51C is formed below the small diameter portion 51B. In the sleeve member 51, a first supply and discharge passage 51D that is in communication with the small diameter portion 51B from the storage space 51A is formed as an oil supply passage for supplying the oil to the pressure-receiving effector 52 and the relay effector 53, and a second supply and discharge passage 51E that is in communication with the large diameter portion 51C from the storage space 51A is formed. Note that although an oil pump driven by the engine E is assumed here, an oil pump driven by an electric motor may also be used.

The pressure-receiving effector 52 has a tubular outer-circumferential face, and a pressure-receiving roller 52R that receives pressure from the abutting body 44 of the rocker arm 40 is rotatably supported at an upper end position of the pressure-receiving effector 52. A lower outer face 52B whose diameter is smaller than that of an upper outer face 52A is formed, and a control body 52C that vertically divides the lower outer face 52B into two parts is formed so as to project outward from the lower outer face 52B. A spring housing space 52D is formed inside the pressure-receiving effector 52, and a compression coil-type intermediate spring 54 is housed therein. The intermediate spring 54 is interposed between the pressure-receiving effector 52 and the relay effector 53, and exerts a biasing force that causes the pressure-receiving effector 52 to project upward. An abutting portion 52E is formed at the lower end of the pressure-receiving effector 52.

The outer diameter of the upper outer face 52A of the pressure-receiving effector 52 is set to a value that is slightly smaller than the inner diameter of the small diameter portion 51B of the sleeve member 51, and the pressure-receiving effector 52 is thereby supported movably in a direction along the valve axis R.

The relay effector 53 has a tubular portion 53A and a bottom wall portion 53B in a lower part and is thereby formed in a tubular shape with a bottom, and a step-like portion 53C that the control body 52C of the pressure-receiving effector 52 can enter is formed on the inner circumference at the upper end (opposite side to the intake valve 10) of the tubular portion 53A. The intermediate spring 54 is disposed between the upper face of the bottom wall portion 53B of the relay effector 53 and the upper wall of the pressure-receiving effector 52, and the relay effector 53 is disposed at a position where the upper end of the valve stem 12 of the intake valve 10 abuts against the bottom face of the bottom wall portion 53B.

A spring having a small biasing force (with a small spring constant) as compared with the valve spring 15 is used as the intermediate spring 54.

The outer diameter of the tubular portion 53A of the relay effector 53 is set to a value that is slightly smaller than the inner diameter of the large diameter portion 51C of the sleeve member 51, and the inner diameter of the tubular portion 53A is set to a value that is slightly larger than the outer diameter of the lower outer face 52B of the pressure-receiving effector 52. Thus, the relay effector 53 is relatively movable in a direction along the valve axis R with respect to the sleeve member 51 and the pressure-receiving effector 52.

An area of the lower outer face 52B of the pressure-receiving effector 52 above the control body 52C is referred to as the fluid space S1, and an area thereof below the control body 52C is referred to as the pressure receiving-side damper space S2. Note that the pressure receiving-side damper space S2 is formed in a portion where the pressure-receiving effector 52 is inserted into the relay effector 53. The restoring-side damper space S3 is formed in an area sandwiched between a step-like face 51S on the boundary between the small diameter portion 51B and the large diameter portion 51C of the sleeve member 51 and an upper end face 53S of the relay effector 53 on the upper-end outer circumference thereof.

With the lash adjuster 50, when pressure is not exerted on the pressure-receiving roller 52R from the abutting body 44 of the rocker arm 40, a state is maintained where the pressure-receiving effector 52 projects upward due to the biasing force of the intermediate spring 54 and causes the pressure-receiving roller 52R to abut against the abutting body 44 of the rocker arm 40. At the time of this projection, when the first supply and discharge passage 51D is in a positional relationship in which it is in communication with the fluid space S1, the pressure-receiving effector 52 projects upward in a state where pressure from the oil is also exerted thereon. Next, when pressure is exerted on the pressure-receiving roller 52R from the abutting body 44 of the rocker arm 40 and the pressure-receiving effector 52 approaches the relay effector 53, the outer-circumferential face of the pressure-receiving effector 52 blocks the first supply and discharge passage 51D, and the oil flowing in and out of the fluid space S1 is blocked. Thereafter, when the pressure-receiving effector 52 further approaches the relay effector 53, the above-described state is switched to a state where the restoring-side damper space S3 is in communication with the second supply and discharge passage 51E. The pressure-receiving effector 52 that thus controls the oil flow in the first supply and discharge passage 51D and the relay effector 53 that controls the oil flow in the second supply and discharge passage 51E constitute a fluid control portion.

Furthermore, in this lash adjuster 50, when the control body 52C is displaced in a direction of closing the pressure receiving-side damper space S2, a gap-like orifice portion 55 is formed between the control body 52C and the inner wall of the pressure receiving-side damper space S2. when the pressure-receiving effector 52 is displaced further downward, the abutting portion 52E at the lower end reaches a state of abutting against the relay effector 53, and achieves a state of directly transmitting the pressure force from the abutting body 44 to the valve stem 12 of the intake valve 10.

Operation Mode of Lash Adjuster

When the lash adjuster 50 is in a non-pressing state where the pressure force is not exerted on the pressure-receiving effector 52 from the abutting body 44 of the rocker arm 40, the valve stem 12 has reached its upper limit due to the biasing force of the valve spring 15. In this state, the pressure-receiving effector 52 projects due to the biasing force of the intermediate spring 54, and the second supply and discharge passage 51E is in a blocked state where the oil flow is blocked. Note that when the first supply and discharge passage 51D is in a positional relationship in which it is in communication with the fluid space S1, the pressure-receiving effector 52 projects upward in a state where the pressure from the oil is also exerted thereon. Accordingly, in this non-pressing state, the pressure-receiving effector 52 projects upward from the sleeve member 51 due to the biasing force of the intermediate spring 54, and the pressure-receiving roller 52R is in a positional relationship in which it abuts against the abutting body 44 of the rocker arm 40. Furthermore, the abutting portion 52E at the lower end of the pressure-receiving effector 52 is in a positional relationship in which it is separate from the relay effector 53.

FIG. 8 shows the cross-section of the lash adjuster 50 immediately after the pressure force is exerted on the pressure-receiving effector 52 from the abutting body 44 due to a pivot of the rocker arm 40 and the pressure-receiving effector 52 begins to lower. In a state where the pressure-receiving effector 52 thus begins to lower, the first supply and discharge passage 51D and the second supply and discharge passage 51E achieve a blocked state, and the fluid space S1, the pressure receiving-side damper space S2, and the restoring-side damper space S3 achieve a state of being in communication with one another. In a state where exertion of the pressure force from the abutting body 44 thus continues, an operation in which the pressure-receiving effector 52 approaches the relay effector 53 against the biasing force of the intermediate spring 54 is performed in a state where the volume of the fluid space S1, the pressure receiving-side damper space S2, and the restoring-side damper space S3 does not change.

Figure 9:
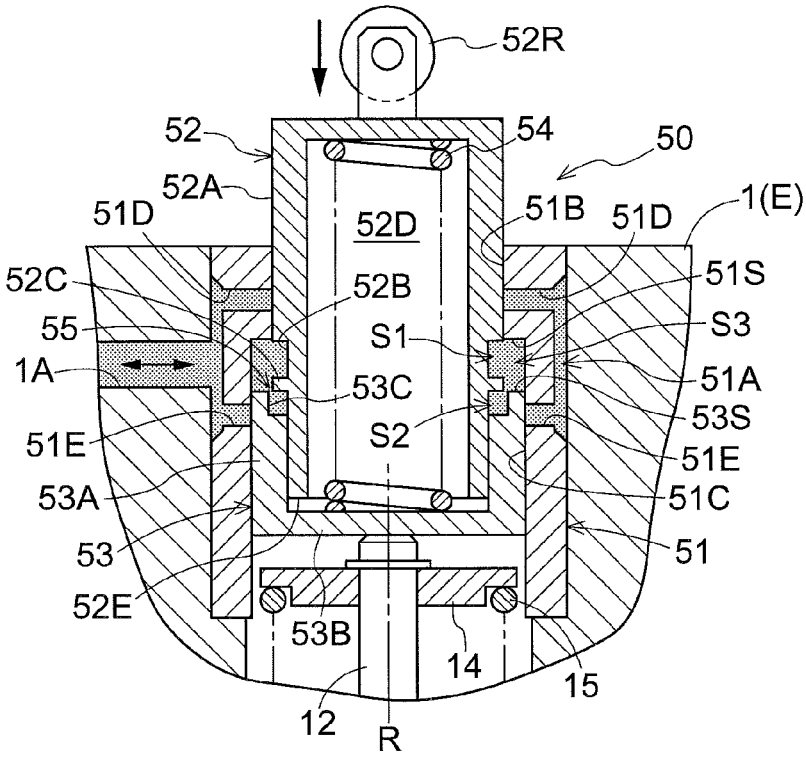
FIG. 9 is a cross-sectional view of the lash adjuster in a state where a pressure receiving-side damper space accomplishes a damper function.

As a result of this operation being performed, as shown in FIG. 9, the control body 52C of the pressure-receiving effector 52 approaches the pressure receiving-side damper space S2, the oil is enclosed in the pressure receiving-side damper space S2, and the orifice portion 55 is formed between the control body 52C and the inner wall of the pressure receiving-side damper space S2. Thus, the volume of the pressure receiving-side damper space S2 decreases, a state is reached where the oil enclosed in the pressure receiving-side damper space S2 leaks into the fluid space S1 and the restoring-side damper space S3 from the orifice portion 55, and the operation of the pressure-receiving effector 52 is suppressed. As a result of reaching this state, the pressure force is transmitted to the pressure-receiving effector 52 via the oil enclosed in the fluid space S1, the pressure receiving-side damper space S2, and the restoring-side damper space S3 with lowering of the pressure-receiving effector 52, and the pressure-receiving effector 52 lowers.

Furthermore, as a result of an increase in the internal pressure of the pressure receiving-side damper space S2, a pressure force is exerted in the downward direction on the relay effector 53 from the pressure-receiving effector 52, and an operation in which the abutting portion 52E of the pressure-receiving effector 52 approaches the bottom wall portion 53B of the relay effector 53 is performed. With this operation, a pressure force in the opening direction is exerted on the intake valve 10 from the relay effector 53, and the intake valve 10 begins to operate in the opening direction.

Figure 10:
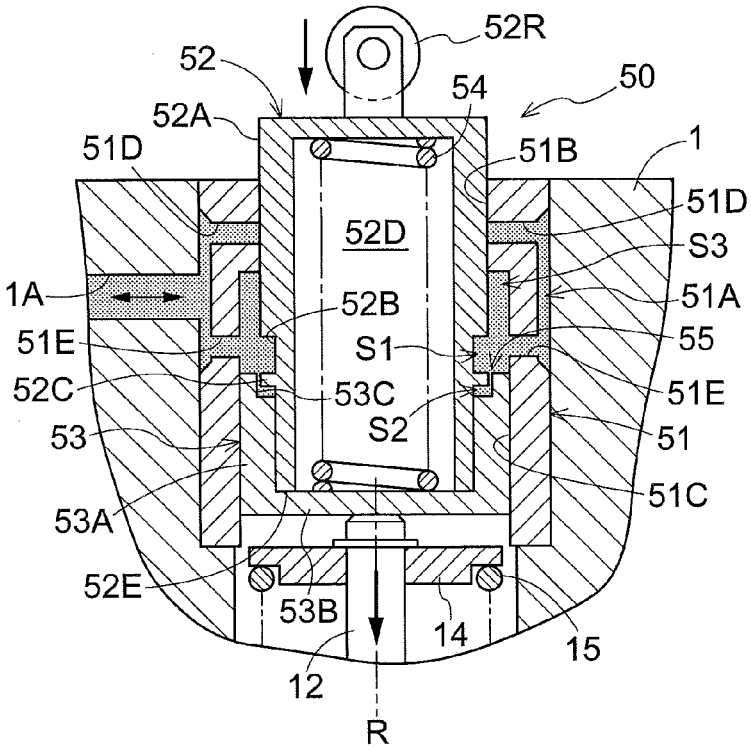
FIG. 10 is a cross-sectional view of the lash adjuster in a state where a pressure force is directly transmitted from the pressure-receiving effector to a relay effector.

Then, as a result of the second supply and discharge passage 51E reaching a position where it is in communication with the restoring-side damper space S3 due to lowering of the relay effector 53, as shown in FIG. 10, a state is reached where the abutting portion 52E of the pressure-receiving effector 52 abuts against the bottom wall portion 53B of the relay effector 53 in a state where only the pressure of the oil enclosed in the pressure receiving-side damper space S2 is exerted on the pressure-receiving effector 52. Consequently, the pressure receiving-side damper space S2 functions such that the lowering speed of the pressure-receiving effector 52 at the time of the abutting is suppressed, and an impact-absorbing operation for absorbing the impact at the time of the abutting is realized. As a result of reaching the abutting state, a pivoting force of the rocker arm 40 is transmitted from the pressure-receiving effector 52 to the relay effector 53, and operates the intake valve 10 in the opening direction.

Figure 11:
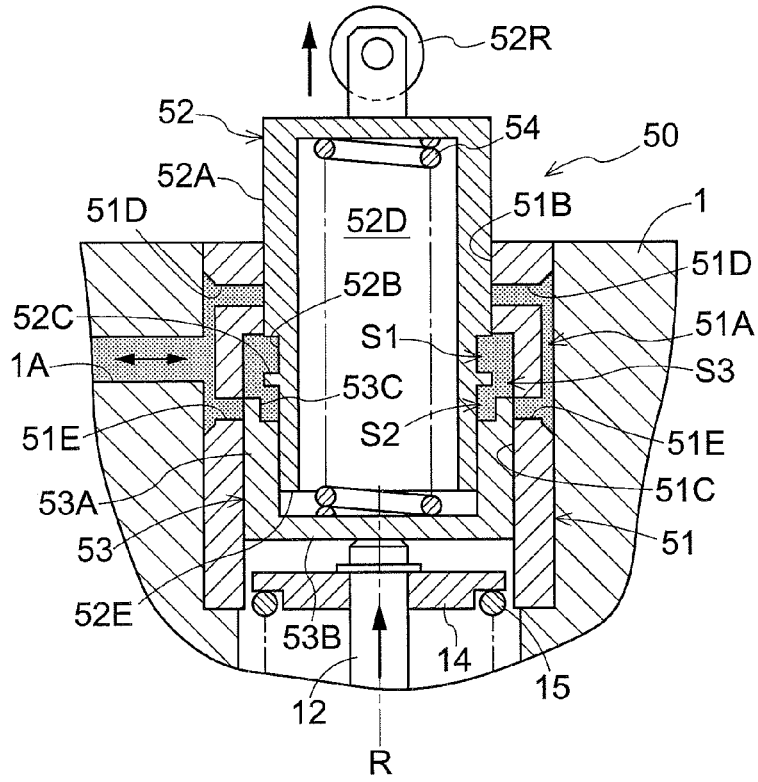
FIG. 11 is a cross-sectional view of the lash adjuster immediately after the relay effector starts a projecting operation due to a biasing force of a valve spring.

After the pressure-receiving effector 52 thus abuts against the bottom wall portion 53B of the relay effector 53 and performs an operation to open the intake valve 10, when an abutting force of the abutting body 44 of the rocker arm 40 is cancelled and the intake valve 10 begins to operate in the closing direction, a state is reached where the oil is enclosed in the fluid space S1, the pressure receiving-side damper space S2, and the restoring-side damper space S3, as shown in FIG. 11. When the pressure-receiving effector 52 is displaced in the upward direction, the volume of these spaces does not change, and therefore the pressure-receiving effector 52 performs a projecting operation due to the biasing force of the intermediate spring 54.

Figure 12:
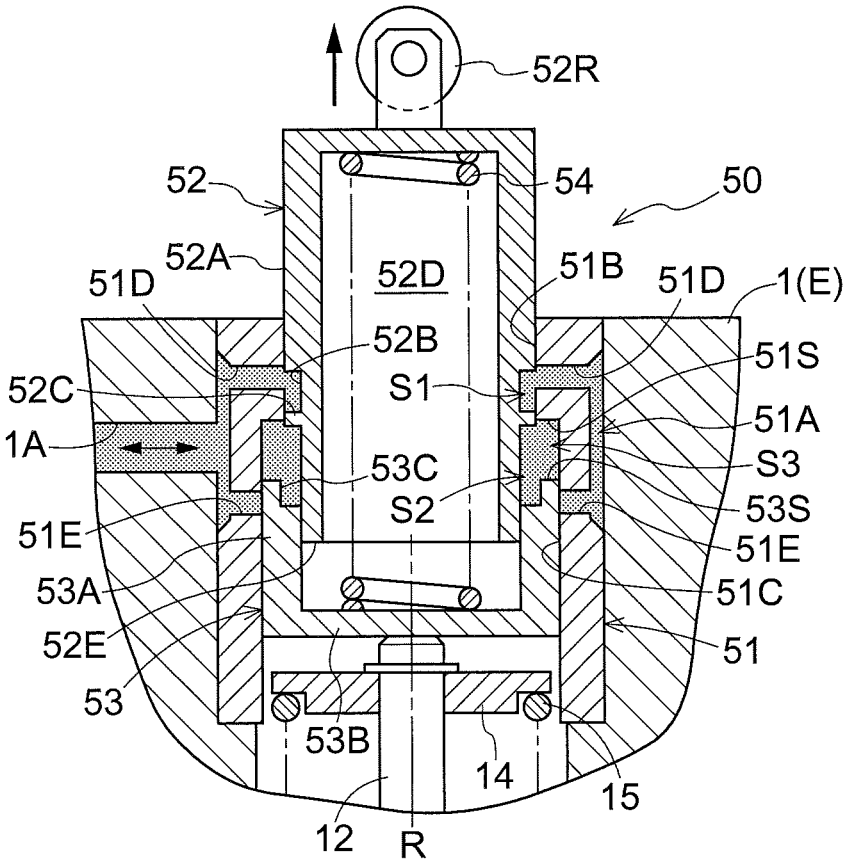
FIG. 12 is a cross-sectional view of the lash adjuster when the relay effector performs the projecting operation.

As a result of the pressure-receiving effector 52 operating in the upward direction due to the biasing force of the intermediate spring 54, a state of causing the pressure-receiving roller 52R to abut against the abutting body 44 is maintained. Furthermore, with this operation of the pressure-receiving effector 52, a state is reached where the pressure receiving-side damper space S2 and the restoring-side damper space S3 are closed, as shown in FIG. 12. In this state, the biasing force of the valve spring 15 is exerted in a direction of elevating the relay effector 53. However, a state is achieved where the oil is enclosed in the restoring-side damper space S3 sandwiched between the step-like face 51S of the sleeve member 51 and the upper end face 53S on the upper-end outer circumference of the relay effector 53, and therefore the elevating speed of the relay effector 53 is suppressed. Consequently, an outflow of the oil from the restoring-side damper space S3 is suppressed even in a situation where the biasing force of the valve spring 15 is exerted, and therefore the elevating speed of the relay effector 53 is suppressed, and the impact at the time when the valve head 11 of the intake valve 10 abuts against the valve seat 16 is absorbed.

Control Configuration, Control Mode

As shown in FIG. 1, the engine control unit 60 includes an input system that acquires a detection signal of the pedal sensor 62 and a detection signal of the angle sensor 34, and also includes an output system that performs output for controlling the actuator A. The engine control unit 60 has table data or the like for setting the pivoting amount of the control member 32 to a target value in accordance with a detected value acquired by the pedal sensor 62, and has a program for operating the actuator A based on this table data or the like.

With this configuration, when controlling the air intake amount based on an operation of the accelerator pedal 61, if it is determined based on a result of the detection by the pedal sensor 62 that the accelerator pedal 61 is in a non-operating state, the engine control unit 60 sets a target value corresponding to idling rotation based on the detected value of the pedal sensor 62 and executes control of the actuator A such that the angle sensor 34 detects a detected value that matches the target value.

Figure 2:
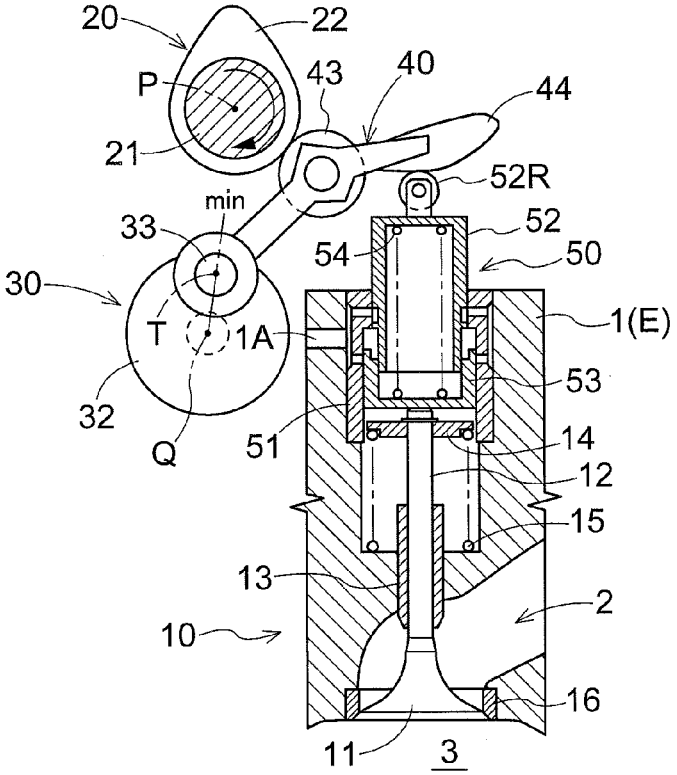
FIG. 2 is a cross-sectional view of a lash adjuster and a valve in a closed state, in a state where an eccentric support portion is at a minimum position.
Figure 3:
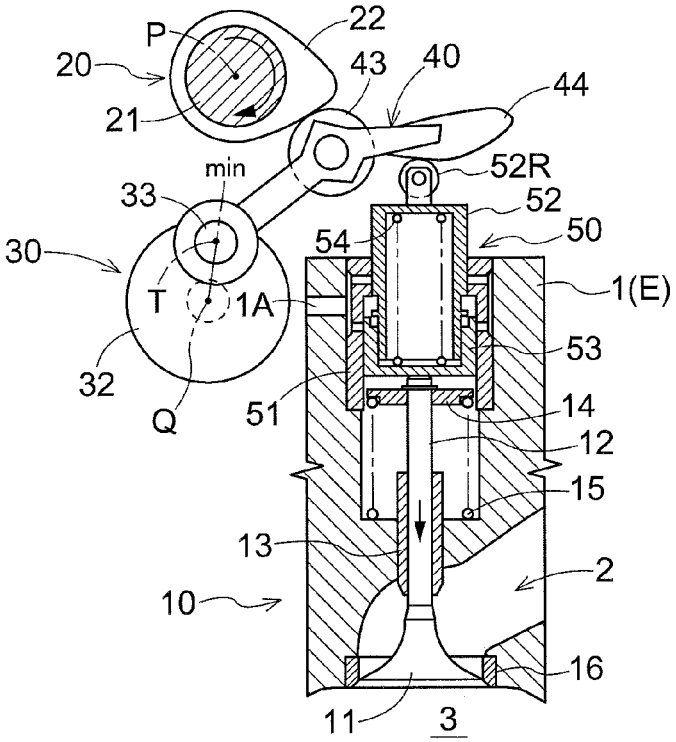
FIG. 3 is a cross-sectional view of the lash adjuster and the valve whose opening operation has been started, in a state where the eccentric support portion is at the minimum position.
Figure 4:
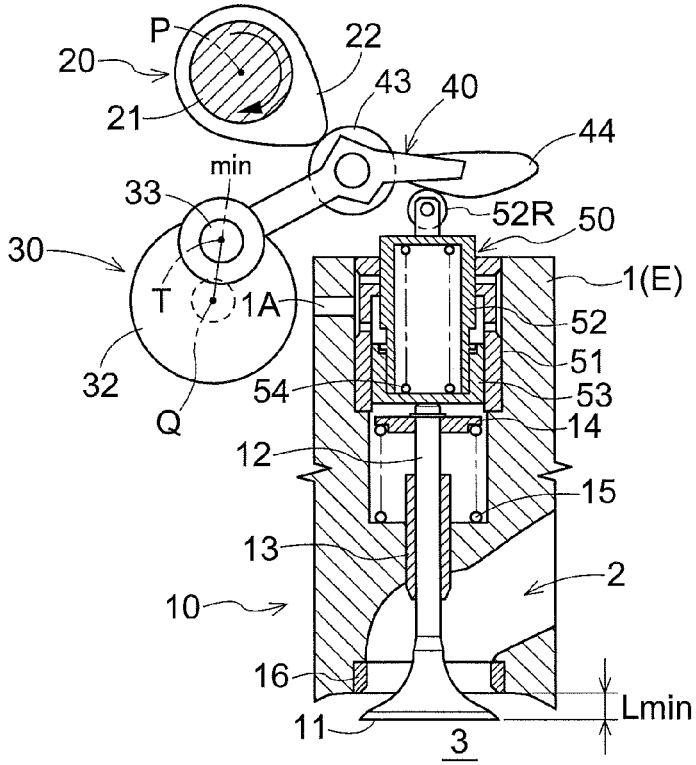
FIG. 4 is a cross-sectional view of the lash adjuster and the valve that has reached the maximum opened state, in a state where the eccentric support portion is at the minimum position.

When setting an idling state, the target value is set such that the eccentric support portion 33 is set at a minimum position as shown in FIGS. 1 to 5. The rocker arm 40 is displaced under this control, and the distance from the position where the abutting body 44 abuts against the pressure-receiving roller 52R to the pivot axis T is set to the minimum. With this control, as shown in FIG. 4, the lift amount of the intake valve 10 at the time when the cam portion 22 of the camshaft 20 abuts against the intermediate roller 43 and the rocker arm 40 pivots is set to the minimum (minimum lift amount Lmin).

Next, when it is determined based on a result of the detection by the pedal sensor 62 that a stepping operation has been performed on the accelerator pedal 61, the engine control unit 60 sets a target value corresponding to the detected value of the pedal sensor 62 and executes control of the actuator A such that the angle sensor 34 detects a detected value that matches the target value.

Figure 6:
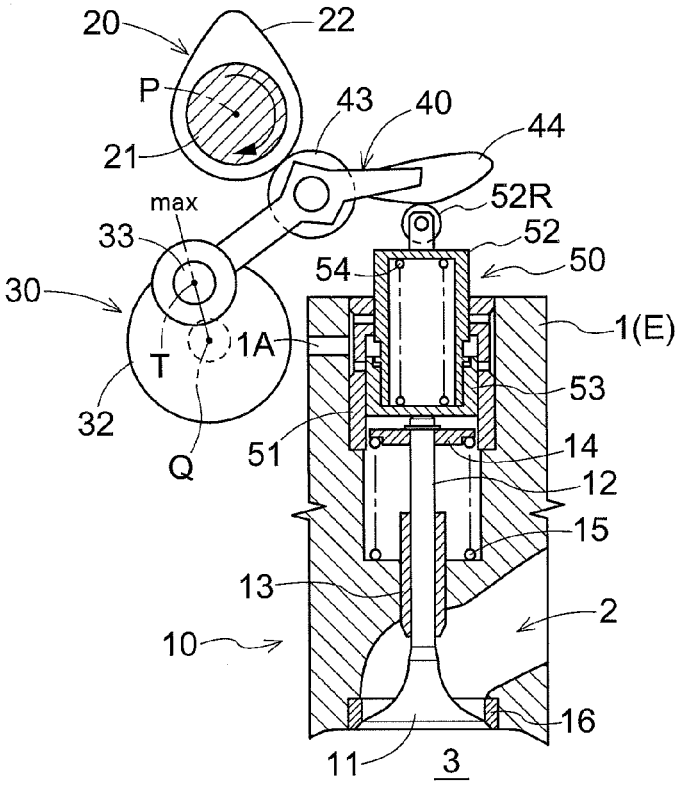
FIG. 6 is a cross-sectional view of the lash adjuster and the valve in the closed state, in a state where the eccentric support portion is at a maximum position.
Figure 7:
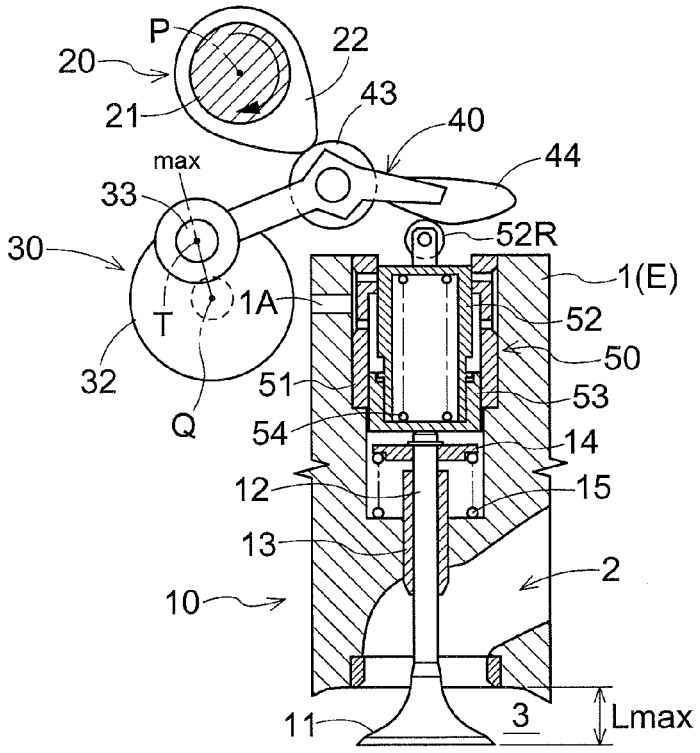
FIG. 7 is a cross-sectional view of the lash adjuster and the valve that has reached the maximum opened state, in a state where the eccentric support portion is at the maximum position.

In this control, when, for example, the stepping operation is performed up to the highest speed position, the target value is set such that the eccentric support portion 33 is set at a maximum position, as shown in FIGS. 6 and 7, and as a result of this control, the rocker arm 40 is displaced, and the distance from the position where the abutting body 44 abuts against the pressure-receiving roller 52R to the pivot axis T is set to the maximum. As a result of this control, as shown in FIG. 7, the lift amount of the intake valve 10 at the time when the cam portion 22 of the camshaft 20 abuts against the intermediate roller 43 and the rocker arm 40 pivots is set to the maximum (maximum lift amount Lmax).

Operation Mode Based on Setting of Eccentric Support Portion

In this valve control mechanism for the engine E, when the eccentric support portion 33 is set at the maximum position, the abutting portion 52E at the lower end of the pressure-receiving effector 52 abuts against the relay effector 53 as shown in FIG. 6, in a state where the intermediate roller 43 of the rocker arm 40 comes into contact with a circumferential portion (base circle) of the cam portion 22 of the camshaft 20. In contrast, if the eccentric support portion 33 is set at the minimum position, the abutting portion 52E at the lower end of the pressure-receiving effector 52 moves away from the relay effector 53 as shown in FIG. 2, in a state where the intermediate roller 43 of the rocker arm 40 comes into contact with the circumferential portion (base circle) of the cam portion 22 of the camshaft 20.

Figure 13:
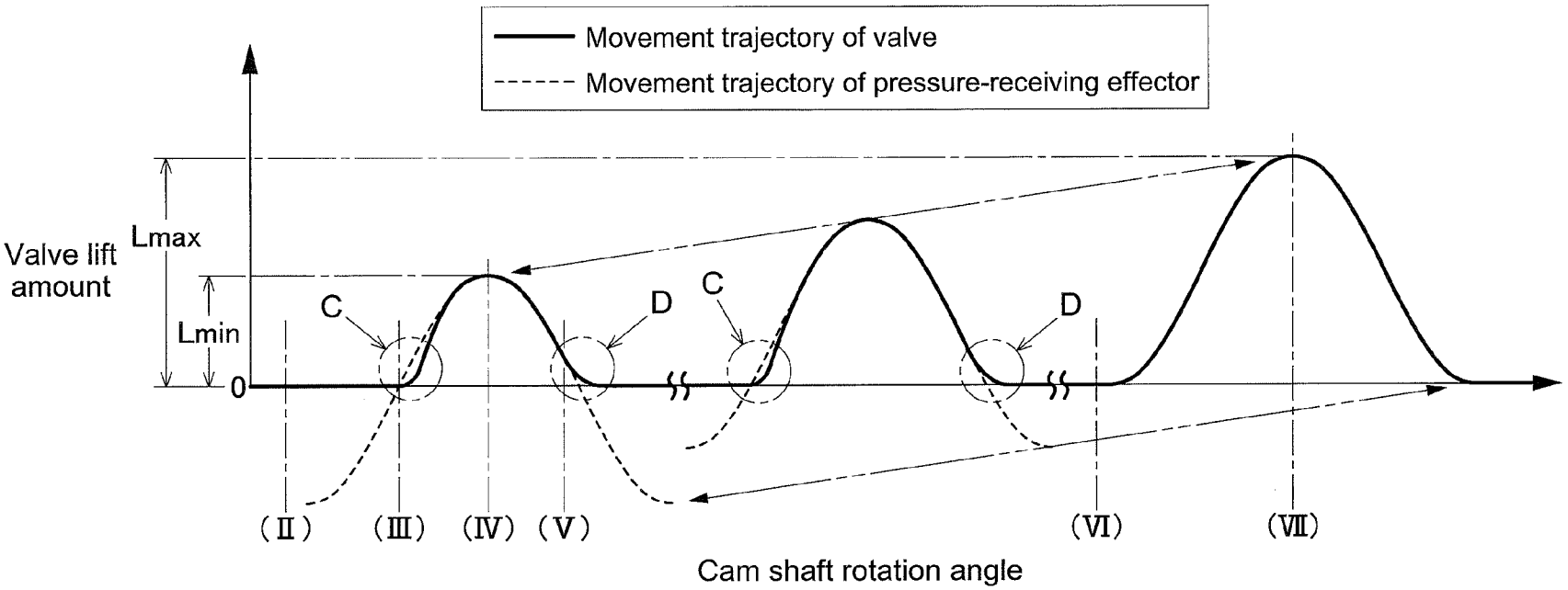
FIG. 13 is a diagram showing a change of the valve lift amount when the eccentric support portion is changed from the minimum position to the maximum position.

FIG. 13 shows a graph with a horizontal axis indicating the rotation angle of the camshaft 20 and a vertical axis indicating the valve lift amount (opening amount of the intake valve 10) in the case of changing the set position of the eccentric support portion 33. As shown in FIG. 13, when the eccentric support portion 33 is set at the maximum position, the intake valve 10 performs an opening and closing operation in conformity with a reference trajectory that reflects the profile of the cam portion 22 of the camshaft 20, and the intake valve 10 is opened by the maximum lift amount Lmax. When the eccentric support portion 33 is gradually displaced from the maximum position to the minimum position, the intake valve 10 performs an operation in conformity with a trajectory in a mode obtained by shifting the reference trajectory downward (only the upper part of the trajectory). When the eccentric support portion 33 is set to the minimum position, the intake valve 10 performs an operation in conformity with a trajectory in a mode of shifting the reference trajectory significantly downward, and the intake valve 10 is opened by the minimum lift amount Lmin.

That is to say, when the eccentric support portion 33 is displaced from the maximum position to the minimum position, an operation that reflects the shape of the cam portion 22 in the vicinity of a raised face (cam nose) thereof is performed. For this reason, as the eccentric support portion 33 is set closer to the minimum position, a mode appears in which the intake valve 10 operates in conformity with a trajectory obtained by shifting the reference trajectory downward (upper area of the trajectory).

Accordingly, in a state where the eccentric support portion 33 is set at the minimum position, the abutting portion 52E at the lower end of the pressure-receiving effector 52 moves away from the relay effector 53 as shown in FIG. 2, at the timing of the intermediate roller 43 coming into contact with the circumferential portion (base circle) of the cam portion 22 of the camshaft 20 with a rotation of the camshaft 20, and the intake valve 10 maintains the closed state (FIG. 13 (II)). Furthermore, at this timing, the lash adjuster 50 achieves a positional relationship in which, due to the pressure of the oil supplied to the fluid space S1 and the biasing force of the intermediate spring 54, the pressure-receiving effector 52 projects upward and abuts against the abutting body 44 of the rocker arm 40.

Next, at the timing of the intermediate roller 43 abutting against a raised portion of the cam portion 22 and the pressure force being exerted on the pressure-receiving effector 52, the opening operation of the intake valve 10 is started as shown in FIG. 3 (FIG. 13 (III)). When the pressure force is thus exerted, the lash adjuster 50 performs a series of operations shown in FIGS. 8 to 10 as described above, and thereby reduces the impact at the time when the abutting portion 52E of the pressure-receiving effector 52 abuts against the bottom wall portion 53B of the relay effector 53. That is to say, as described above, the impact is reduced by performing an operation of transmitting the pressure force from the relay effector 53 to the intake valve 10 in a mode of enclosing the oil in the fluid space S1, the pressure receiving-side damper space S2, and the restoring-side damper space S3, and performing an impact-absorbing operation of leaking the oil enclosed in the pressure receiving-side damper space S2 from the orifice portion 55 with a reduction in the volume of the pressure receiving-side damper space S2.

In order to thus reduce the impact, an opening start curve C at the time when the intake valve 10 begins to be opened indicates a low-speed opening operation, unlike a reference curve.

Figure 5:
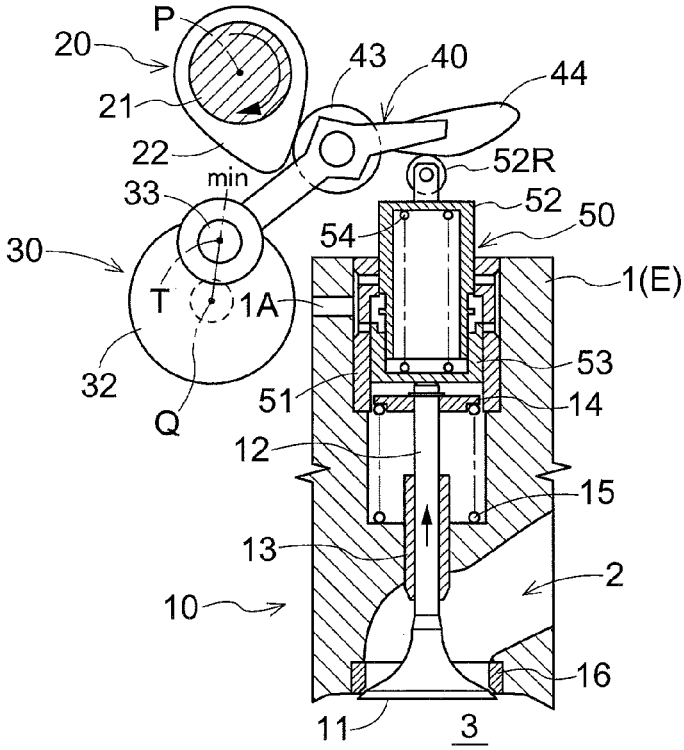
FIG. 5 is a cross-sectional view of the lash adjuster and the valve that has restored the closed state from the opened state, in a state where the eccentric support portion is at the minimum position.

Thereafter, as a result of the pressure force from the pressure-receiving effector 52 being transmitted from the relay effector 53 to the intake valve 10 in a state where the abutting portion 52E abuts against the bottom wall portion 53B, the intake valve 10 is opened by the smallest lift amount Lmin as shown in FIG. 4 (FIG. 13(IV)). At the timing of the pressure force exerted on the intermediate roller 43 from the raised portion of the cam portion 22 being cancelled, the abutting portion 52E at the lower end of the pressure-receiving effector 52 moves away from the relay effector 53, and the intake valve 10 is restored to the closed state, as shown in FIG. 5 (FIG. 13(V)). Furthermore, when the pressure force is thus cancelled, at the time of the closing operation of the intake valve 10, the impact at the time when the valve head 11 abuts against the valve seat 16 is reduced due to the oil enclosed in the restoring-side damper space S3, as shown in FIG. 11.

In order to thus reduce the impact, an opening end curve D at the time of the closing operation of the intake valve 10 indicates a low-speed closing operation, unlike the reference curve.

Similarly, in a state where the eccentric support portion 33 is set at the maximum position, at the timing of the intermediate roller 43 coming into contact with the circumferential portion (base circle) of the cam portion 22 of the camshaft 20, the intake valve 10 maintains the closed state in a state where the abutting portion 52E at the lower end of the pressure-receiving effector 52 abuts against the relay effector 53, as shown in FIG. 6 (FIG. 13(VI)). Furthermore, at this timing, the lash adjuster 50 achieves a positional relationship in which, due to the pressure of the oil supplied to the fluid space S1 and the biasing force of the intermediate spring 54, the pressure-receiving effector 52 projects upward and abuts against the abutting body 44 of the rocker arm 40.

Next, with a rotation of the camshaft 20, a pressure force is exerted on the intermediate roller 43 from the time point when the intermediate roller 43 reaches a boundary portion of the raised face (cam nose) of the cam portion 22 from the circumferential portion, and the opening operation of the intake valve 10 is smoothly started. Subsequently, the opening operation is performed with a characteristic that reflects the cam shape of the raised face, as shown in FIG. 7 (FIG. 13(VII)).

Thus, in a state where the eccentric support portion 33 is set at the maximum position, at the time of the opening operation, a smooth opening operation is performed while a state where the abutting portion 52E at the lower end of the pressure-receiving effector 52 abuts against the relay effector 53 is maintained. For this reason, the impact-absorbing operation in the lash adjuster 50 is not required, and therefore this impact-absorbing operation is not performed.

Effects of First Embodiment

As described above, with the valve control mechanism of the present embodiment, the shift amount of the rocker arm 40 in the longitudinal direction is set by controlling the actuator A based on the stepping operation on the accelerator pedal 61, the lift amount of the intake valve 10 is continuously changed, and the air intake timing of the intake valve 10 can also be changed in conjunction with this change of the lift amount. In particular, since the air intake amount can be adjusted by changing the lift amount of the intake valve 10 without adjusting the air intake amount with a throttle valve, an improvement in fuel efficiency is realized by reducing air intake resistance at the throttle valve, and consequently reducing pumping loss.

With the configuration of the present embodiment, a change of the lift amount of the intake valve 10 can be realized due to provision of the configuration in which the base end portion of the rocker arm 40 is supported by the eccentric support portion 33 formed in the control member 32, the actuator A that rotates the control member 32, and the angle sensor 34 that detects the rotation angle. For this reason, the number of components of the valve control mechanism can be reduced.

Furthermore, since the rocker arm 40 is provided with the intermediate roller 43 at an intermediate position in the longitudinal direction, when the cam portion 22 of the camshaft 20 abuts against the intermediate roller 43, smooth abutting is realized and friction is also suppressed due to the rotation of the intermediate roller 43.

With this configuration, an operation mode is employed in which the abutting body 44 of the rocker arm 40 abuts against the pressure-receiving roller 52R of the pressure-receiving effector 52 at a high speed. At the time of this abutting, the pressure-receiving roller 52R rotates, the lash adjuster 50 suppresses the impact at the time when the abutting body 44 of the rocker arm 40 abuts, and a reduction in an impact sound is also realized. Similarly, the lash adjuster 50 also suppresses the impact at the time when the abutting body 44 operates in the direction of moving away from the pressure-receiving roller 52R and the intake valve 10 operates in the closing direction, and a reduction of an impact sound is also realized. Thus, an engine sound is reduced, and the quietness is improved.

2. Second Embodiment

Next, a second embodiment of the present invention will be described based on the drawings. In the following description of the embodiment, the same reference numerals will be given to the same configurations as those in the first embodiment, and descriptions related to the same configurations will be omitted. The present embodiment is different from the first embodiment in that the shape of the lash adjuster 50 is changed, and in that the stopper 14 is not provided and the biasing force of the valve spring 15 is directly received by the relay effector 53, but the rest of the structure is the same. Specifically, the pressure receiving-side damper space S2 and the restoring-side damper space S3 are aligned in the radial direction of the lash adjuster 50, and the arrangement of the first supply and discharge passage 51D and the second supply and discharge passage 51E is also changed accordingly. Furthermore, the relay effector 53 and the intake valve 10 are integrated with each other by means of welding or other methods.

Lash Adjuster

Figure 14:
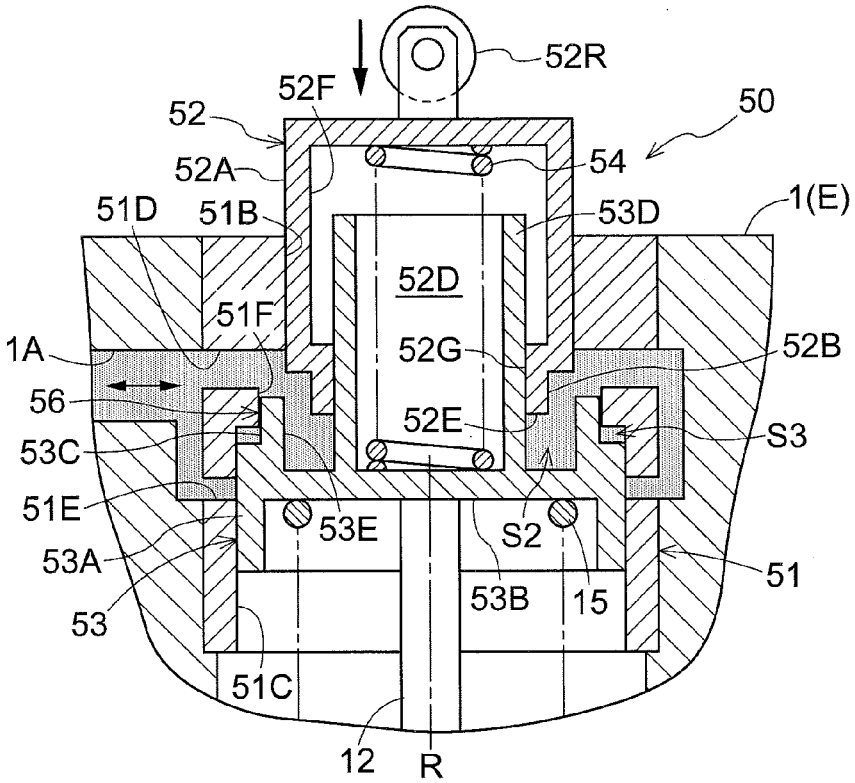
FIG. 14 is a cross-sectional view of a lash adjuster according to a second embodiment, in a state where a pressure force is not exerted on a pressure-receiving effector.

As shown in FIG. 14, the lash adjuster 50 has a configuration in which the pressure-receiving effector 52 and the relay effector 53 are inserted in a slidable state and in a relatively movable manner, into the sleeve member 51 that is fitted and fixed to the cylinder head 1 serving as a fixture system. The sleeve member 51, the pressure-receiving effector 52, and the relay effector 53 are disposed coaxially with the valve axis R of the valve stem 12 of the intake valve 10, and the pressure-receiving effector 52 and the relay effector 53 are supported so as to be able to move back and forth along the valve axis R. The lash adjuster 50 also includes an oil passage system that supplies and discharges oil serving as a working fluid to and from the aforementioned spaces. While the lash adjuster 50 works regardless of the orientation thereof, the positional relationship, configurations, and the like will be described based on the orientation shown in FIG. 14. Note that in the present embodiment, the fluid space S1 does not exist, and only the pressure receiving-side damper space S2 and the restoring-side damper space S3 are formed. The detailed configuration will be described later.

The sleeve member 51 is formed in a ring shape as a whole, and the outer diameter thereof is fixed. The inside of the sleeve member 51 is formed such that the inner diameter thereof increases in three steps from the upper side (opposite side to the intake valve 10), in the order of the small diameter portion 51B, a middle diameter portion 51F, and the large diameter portion 51C. In the cylinder head 1, the oil passage 1A for supplying the oil from a hydraulic pump (not shown) to the pressure-receiving effector 52 and the relay effector 53 is formed. In the sleeve member 51, the first supply and discharge passage 51D that is in communication with the small diameter portion 51B from the oil passage 1A is formed, and the second supply and discharge passage 51E that is in communication with the large diameter portion 51C from the oil passage 1A is formed. Note that although an oil pump driven by the engine E is assumed here, an oil pump driven by an electric motor may also be used.

The outer diameter of the pressure-receiving effector 52 changes in two steps, and the upper outer face 52A having a larger diameter and the lower outer face 52B having a smaller diameter are formed. The inner diameter of the pressure-receiving effector 52 also changes in two steps, and an upper inner face 52F having a larger diameter and a lower inner face 52G having a smaller diameter are formed. The outer diameter of the upper outer face 52A of the pressure-receiving effector 52 is set to a value that is slightly smaller than the inner diameter of the small diameter portion 51B of the sleeve member 51, and the pressure-receiving effector 52 is thereby supported movably in a direction along the valve axis R.

The relay effector 53 has the tubular portion 53A, the bottom wall portion 53B in a lower part, and an inner tubular portion 53D. The tubular portion 53A projects on two sides, namely the intake valve 10 side with respect to the bottom wall portion 53B and the opposite side thereto. The inner diameter of the tubular portion 53A is larger on the intake valve 10 side with respect to the bottom wall portion 53B, and is smaller on the opposite side thereto. The inner face of the tubular portion 53A on the opposite side to the intake valve 10 is referred to as a tubular portion inner face 53E. The inner tubular portion 53D has an outer diameter that is smaller than the inner diameter of the tubular portion 53A, and projects only on the opposite side to the intake valve 10. The step-like portion 53C capable of being fitted into the middle diameter portion 51F of the sleeve member 51 is formed on the outer circumference at the upper end (opposite side to the intake valve 10) of the tubular portion 53A. The inner tubular portion 53D is fitted to the inside of the pressure-receiving effector 52. The intermediate spring 54 is disposed within the inner tubular portion 53D between the upper face of the bottom wall portion 53B of the relay effector 53 and the upper wall of the pressure-receiving effector 52, and the relay effector 53 is disposed at a position where the upper end of the valve stem 12 of the intake valve 10 abuts against the bottom face of the bottom wall portion 53B.

The outer diameter of the tubular portion 53A of the relay effector 53 is set to a value that is slightly smaller than the inner diameter of the large diameter portion 51C of the sleeve member 51, and the outer diameter of the inner tubular portion 53D is set to a value that is slightly smaller than the inner diameter of the lower inner face 52G of the pressure-receiving effector 52. The relay effector 53 can thereby move relatively in a direction along the valve axis R with respect to the sleeve member 51 and the pressure-receiving effector 52, and prevents the oil enclosed in the pressure receiving-side damper space S2 from permeating the inside of the pressure-receiving effector 52.

An area formed by the tubular portion 53A and the inner tubular portion 53D of the relay effector 53 and the lower outer face 52B of the pressure-receiving effector 52 is referred to as the pressure receiving-side damper space S2. The restoring-side damper space S3 is formed in an area sandwiched by the large diameter portion 51C of the sleeve member 51 and the step-like portion 53C of the relay effector 53. That is to say, the pressure receiving-side damper space S2 is formed on the inside with respect to the radial direction of the lash adjuster 50, and the restoring-side damper space S3 is formed on the outside with respect thereto. With this configuration, a reduction in the size of the lash adjuster 50 can be achieved by shortening the axial length thereof. Furthermore, the pressure receiving-side damper space S2 is formed by the pressure-receiving effector 52 and the relay effector 53, and the restoring-side damper space S3 is formed by the sleeve member 51 and the relay effector 53. Thus, as a result of the pressure receiving-side damper space S2 and the restoring-side damper space S3 being formed respectively by two parts, the shape and performance of each of the pressure receiving-side damper space S2 and the restoring-side damper space S3 can be stabilized only by managing the dimensions of the corresponding two parts, and the lash adjuster 50 having an excellent impact-absorbing function can be easily obtained.

As shown in FIG. 14, in a state where pressure is not exerted on the pressure-receiving roller 52R from the abutting body 44 of the rocker arm 40 in the lash adjuster 50, a state is maintained where the pressure-receiving effector 52 projects upward due to a biasing force of the intermediate spring 54 and the pressure-receiving roller 52R is caused to abut against the abutting body 44 of the rocker arm 40. At the time of this projection, when the first supply and discharge passage 51D is in a positional relationship in which it is in communication with the pressure receiving-side damper space S2, the pressure-receiving effector 52 projects upward in a state where pressure from the oil is also exerted thereon. Next, when pressure is exerted on the pressure-receiving roller 52R from the abutting body 44 of the rocker arm 40 and the pressure-receiving effector 52 approaches the relay effector 53, the upper outer face 52A of the pressure-receiving effector 52 closes the first supply and discharge passage 51D, and the oil flowing in and out of the pressure receiving-side damper space S2 is restricted. Thus, the pressure-receiving effector 52 that controls the oil flow in the first supply and discharge passage 51D and the relay effector 53 that controls the oil flow in the second supply and discharge passage 51E constitute a fluid control portion.

Figure 15:
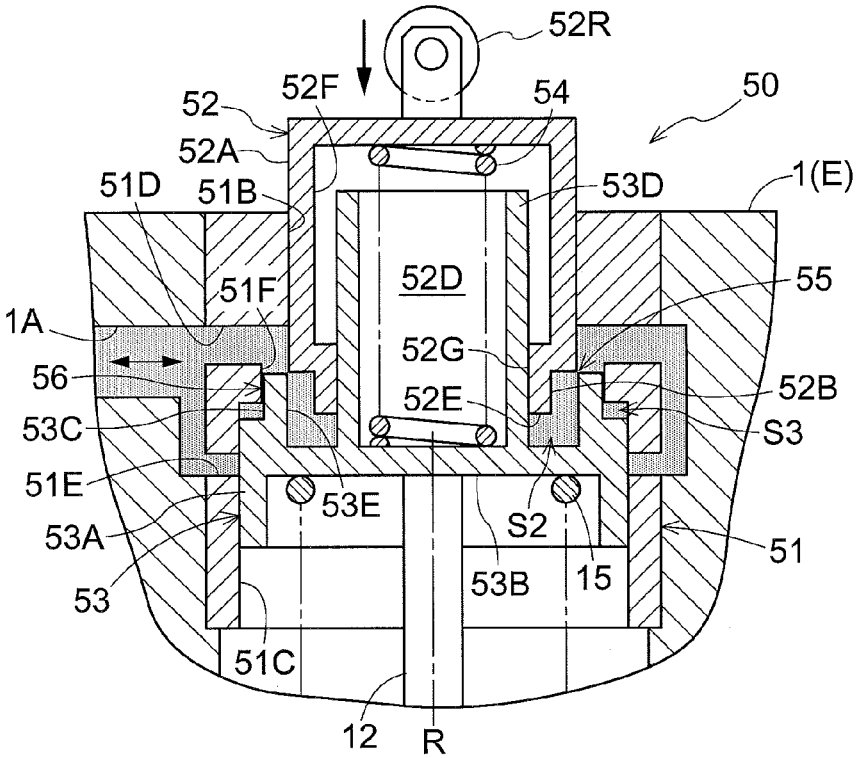
FIG. 15 is a cross-sectional view of the lash adjuster in a state where a pressure receiving-side damper space accomplishes a damper function.

Furthermore, as shown in FIG. 15, when the upper outer face 52A of the pressure-receiving effector 52 is displaced in a direction of closing the pressure receiving-side damper space S2 in the lash adjuster 50, the gap-like orifice portion 55 is formed between the upper outer face 52A and the tubular portion inner face 53E, and the oil in the pressure receiving-side damper space S2 comes into communication with the first supply and discharge passage 51D via the orifice portion 55. When the pressure-receiving effector 52 is displaced further downward, the abutting portion 52E at the lower end reaches a state of abutting against the relay effector 53, and a state is achieved where the pressure force from the abutting body 44 is directly transmitted to the valve stem 12 of the intake valve 10.

Operation Mode of Lash Adjuster

As shown in FIG. 14, when the lash adjuster 50 is in a non-pressing state where the pressure force is not exerted on the pressure-receiving effector 52 from the abutting body 44 of the rocker arm 40, the valve stem 12 has reached its upper limit due to the biasing force of the valve spring 15. In this state, the pressure-receiving effector 52 projects due to the biasing force of the intermediate spring 54, and the second supply and discharge passage 51E is in a blocked state where the oil flow is blocked. At this time, since the first supply and discharge passage 51D is in communication with the pressure receiving-side damper space S2, the pressure-receiving effector 52 projects upward in a state where pressure from the oil is also exerted thereon. Accordingly, in this non-pressing state, the pressure-receiving effector 52 projects upward from the sleeve member 51 due to the biasing force of the intermediate spring 54, and the pressure-receiving roller 52R is in a positional relationship in which it abuts against the abutting body 44 of the rocker arm 40. Furthermore, the abutting portion 52E at the lower end of the pressure-receiving effector 52 is in a positional relationship in which it is separate from the relay effector 53.

Upon a pressure force being exerted on the pressure-receiving effector 52 from the abutting body 44 due to the pivoting of the rocker arm 40 and the pressure-receiving effector 52 beginning to lower, the upper outer face 52A of the pressure-receiving effector 52 closes the first supply and discharge passage 51D, and the oil flowing in and out of the pressure receiving-side damper space S2 is restricted. In a state where exertion of the pressure force from the abutting body 44 thus continues, although the pressure-receiving effector 52 performs an operation of approaching the relay effector 53 against the biasing force of the intermediate spring 54, the relay effector 53 is biased by the biasing force of the valve spring 15 and does not move. For this reason, the volume of the pressure receiving-side damper space S2 decreases.

As a result of this operation being performed, the upper outer face 52A of the pressure-receiving effector 52 approaches the tubular portion inner face 53E, the oil is enclosed in the pressure receiving-side damper space S2, and the orifice portion 55 is formed between the upper outer face 52A and the tubular portion inner face 53E. FIG. 15 shows this state. Although the volume of the pressure receiving-side damper space S2 thereby decreases, at this time a state is achieved where the oil enclosed in the pressure receiving-side damper space S2 needs to pass through the orifice portion 55 in order to be discharged to the first supply and discharge passage 51D, and therefore the oil discharging speed decreases, and the operation speed of the pressure-receiving effector 52 is suppressed. However, the lowering of the pressure-receiving effector 52 continues.

Figure 16:
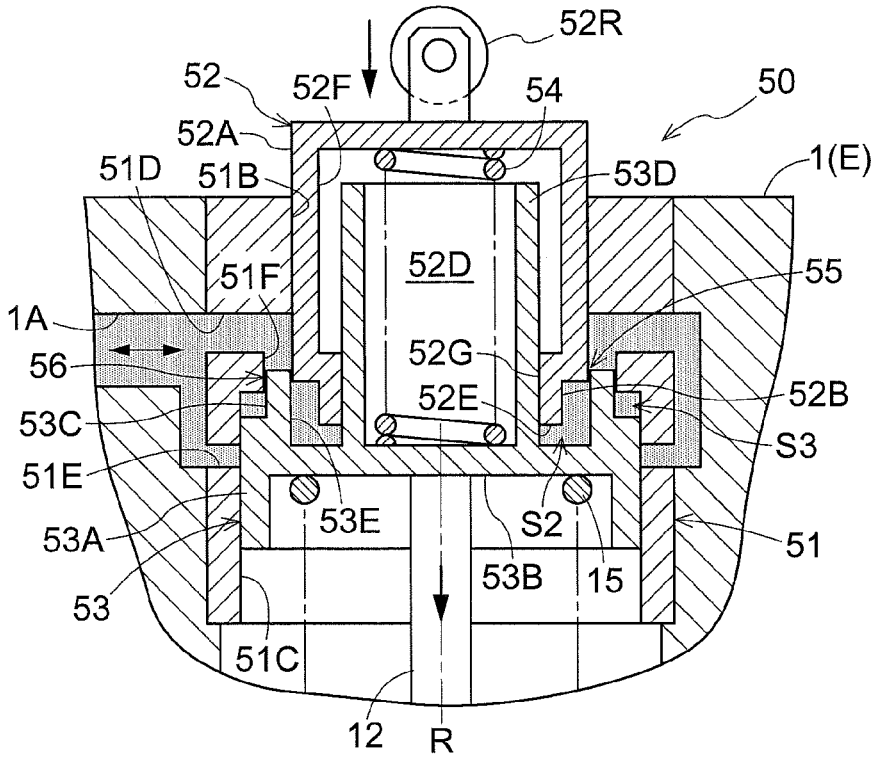
FIG. 16 is a cross-sectional view of the lash adjuster in a state where the pressure receiving-side damper space accomplishes a damper function, immediately after a relay effector begins to operate.

Since the internal pressure of the pressure receiving-side damper space S2 increases with the lowering of the pressure-receiving effector 52, a pressure force is exerted in the downward direction on the relay effector 53 from the pressure-receiving effector 52. Thus, a pressure force in the opening direction is exerted on the intake valve 10 from the relay effector 53, and the intake valve 10 begins to operate in the opening direction, as shown in FIG. 16.

Figure 17:
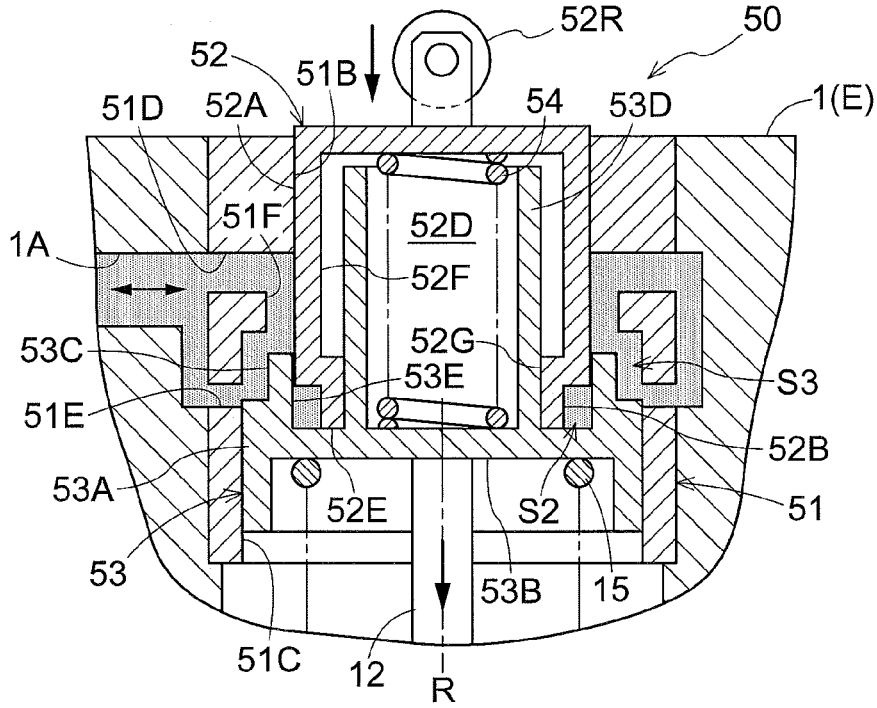
FIG. 17 is a cross-sectional view of the lash adjuster in a state where a pressure force is directly transmitted from the pressure-receiving effector to the relay effector.

Thereafter, as shown in FIG. 17, a state is reached where the abutting portion 52E of the pressure-receiving effector 52 abuts against the bottom wall portion 53B of the relay effector 53. At this time, the abutting portion 52E abuts against the bottom wall portion 53B in a state where the pressure receiving-side damper space S2 functions and the lowering speed of the pressure-receiving effector 52 is suppressed, and an impact-absorbing operation of absorbing the impact at the time of the abutting is realized. As a result of the abutting state being reached, a pivoting force of the rocker arm 40 is transmitted from the pressure-receiving effector 52 to the relay effector 53, and operates the intake valve 10 in the opening direction. As a result of the relay effector 53 operating in the opening direction, the restoring-side damper space S3 comes into communication with the first supply and discharge passage 51D and the second supply and discharge passage 51E, and the oil is supplied to the restoring-side damper space S3. With this configuration, the oil can be stably supplied to the restoring-side damper space S3, and the impact-absorbing function of the restoring-side damper space S3 can be stably accomplished.

Figure 18:
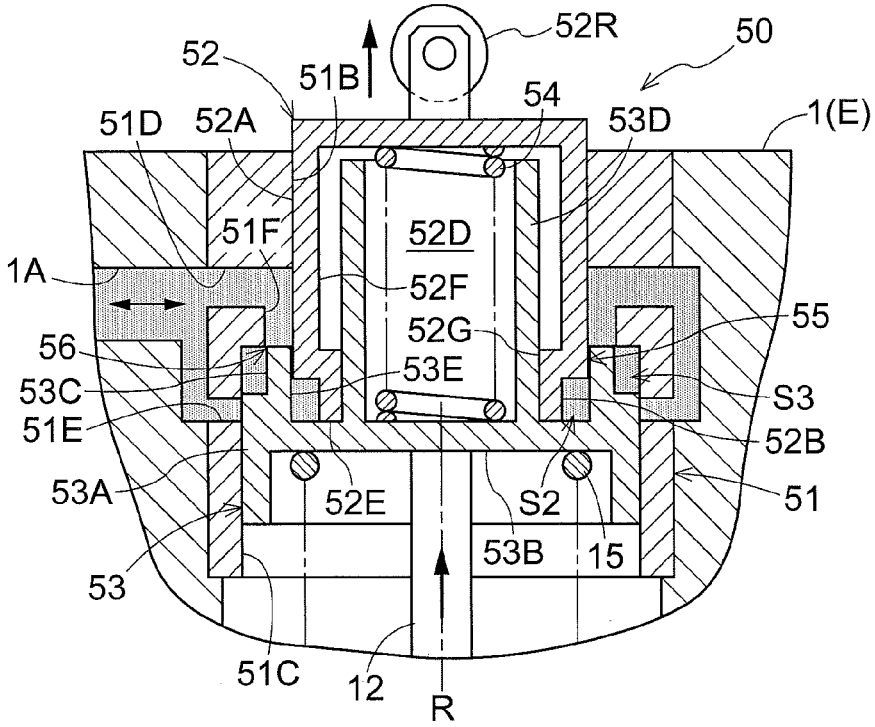
FIG. 18 is a cross-sectional view of the lash adjuster in a state where the relay effector performs a projecting operation due to a biasing force of a valve spring and a restoring-side damper space accomplishes a damper function.
Figure 19:
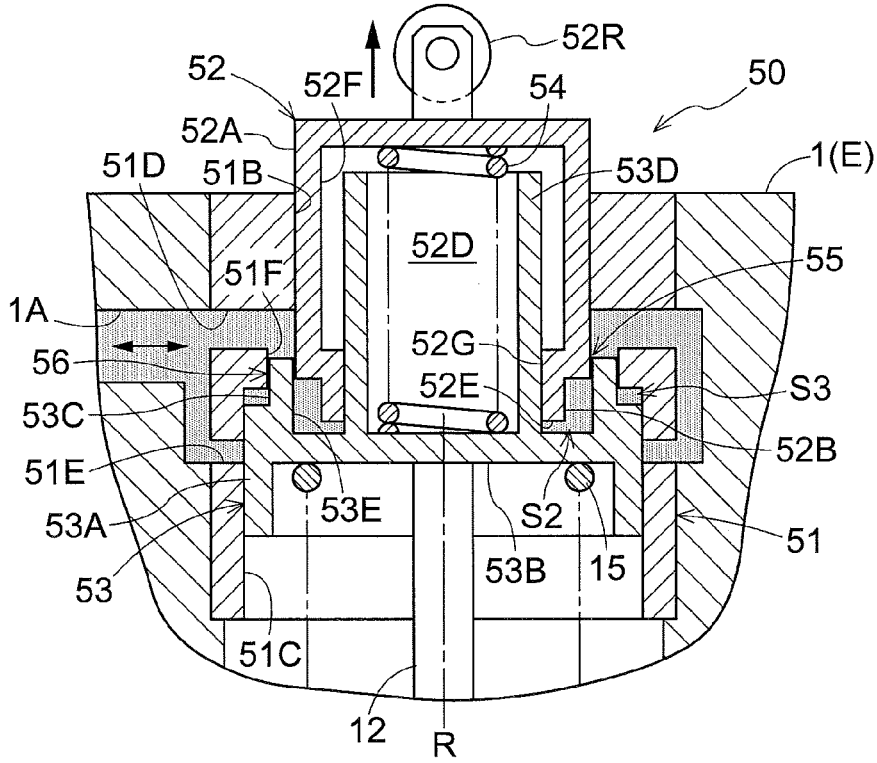
FIG. 19 is a cross-sectional view of the lash adjuster in a state where the restoring-side damper space accomplishes a damper function and the pressure-receiving effector performs a projecting operation.

After the pressure-receiving effector 52 thus abuts against the bottom wall portion 53B of the relay effector 53 and performs an operation of opening the intake valve 10, when an abutting force of the abutting body 44 of the rocker arm 40 is cancelled and the intake valve 10 begins to operate in the closing direction, the pressure-receiving effector 52 and the relay effector 53 integrally move upward due to the biasing force of the valve spring 15. Thus, the volume of the restoring-side damper space S3 decreases. With this upward movement, the second supply and discharge passage 51E is closed by the outer-circumferential face of the tubular portion 53A, and the oil supply from the second supply and discharge passage 51E to the restoring-side damper space S3 is blocked. Furthermore, at this time, as shown in FIG. 18, a gap-like restoring orifice portion 56 is formed between the step-like portion 53C of the relay effector 53 and the middle diameter portion 51F of the sleeve member 51, and the oil in the restoring-side damper space S3 comes into communication with the first supply and discharge passage 51D via the restoring orifice portion 56. Since a state is thereby achieved where the oil enclosed in the restoring-side damper space S3 needs to pass through the restoring orifice portion 56 in order to be discharged to the first supply and discharge passage 51D, the operation speed of the relay effector 53 is suppressed with the decrease of the oil discharging speed, and the relay effector 53 moves upward. Even if the operation speed of the relay effector 53 is suppressed, the biasing force of the intermediate spring 54 is still exerted on the pressure-receiving effector 52. Accordingly, the operation speed of the pressure-receiving effector 52 does not decrease, the abutting portion 52E of the pressure-receiving effector 52 moves away from the bottom wall portion 53B of the relay effector 53, and the pressure-receiving effector 52 solely performs a projecting operation.

As a result of the pressure-receiving effector 52 operating in the upward direction due to the biasing force of the intermediate spring 54, a state of causing the pressure-receiving roller 52R to abut against the abutting body 44 is maintained. In this state, although the biasing force of the valve spring 15 is exerted in a direction of elevating the relay effector 53, a state is achieved where the oil is enclosed in the restoring-side damper space S3, and accordingly the elevating speed of the relay effector 53 is suppressed. Thus, even in a situation where the biasing force of the valve spring 15 is exerted, the valve head 11 abuts against the valve seat 16 in a state where the elevating speed of the intake valve 10 integrated with the relay effector 53 is suppressed by the functioning of the restoring-side damper space S3, and the impact-absorbing operation of absorbing the impact at the time of the abutting is realized.

3. Other Embodiments

Embodiments other than the above embodiments may also be employed to configure the present invention.

(a) The pressure receiving-side damper space S2 is formed at an insertion portion of the pressure-receiving effector 52 and the relay effector 53, and the control body 52C that operates in a direction of closing the pressure receiving-side damper space S2 when the pressure-receiving effector 52 and the relay effector 53 move in approaching directions is formed in the relay effector 53.

(b) The orifice portion 55 is formed in a hole shape or a slit shape in the control body 52C. As a result of thus forming the orifice portion 55, the cross-sectional area in which the oil flows in the orifice portion 55 can be fixed.

(c) A configuration is employed in which the rocker arm 40 is not used and the cam portion 22 of the camshaft 20 comes into direct contact with the pressure-receiving effector 52 so as to exert a pressure force thereon.

INDUSTRIAL APPLICABILITY

The present invention can be used as general lash adjusters for engine valves.

REFERENCE SIGNS LIST

10: Valve (intake valve)
50: Lash adjuster
51: Sleeve member
51D: Oil supply passage (first supply and discharge passage)
51E: Oil supply passage (second supply and discharge passage)
52: Pressure-receiving effector
52C: Control body
53: Relay effector
54: Intermediate spring
55: Orifice portion
S2: Pressure receiving-side damper space
S3: Restoring-side damper space

The invention claimed is:

1. A lash adjuster comprising:

a pressure-receiving effector that moves back and forth in an operating direction of a valve, due to a pressure force;

a relay effector that can relatively move with respect to the pressure-receiving effector while the relay effector and the pressure-receiving effector are in an inserted relationship with each other, and that abuts against the valve and moves back and forth in the operating direction;

an intermediate spring that abuts against the pressure-receiving effector and the relay effector and biases the pressure-receiving effector and the relay effector in separate directions; and a sleeve member into which the pressure-receiving effector and the relay effector are slidably inserted, and that is provided with an oil supply passage for supplying a working fluid to the pressure-receiving effector and the relay effector, wherein a pressure receiving-side damper space whose volume decreases as the pressure-receiving effector is pressed in due to the pressure force and the distance between the pressure-receiving effector and the relay effector is shortened, and an orifice portion that suppresses an outflow of the working fluid from the pressure receiving-side damper space is formed between the pressure-receiving effector and the relay effector, and a restoring-side damper space whose volume decreases as the relay effector is pressed back by the valve is formed so as to span between the relay effector and the sleeve member.

2. The lash adjuster according to claim 1, wherein the restoring-side damper space is formed in an area that is continuous with the pressure receiving-side damper space, and a control body that is displaced in a direction of closing the pressure receiving-side damper space when the pressure-receiving effector is displaced in a direction of approaching the relay effector is formed in at least one of the pressure-receiving effector and the relay effector, and the orifice portion is formed between the control body and an inner wall of the pressure receiving-side damper space.

3. The lash adjuster according to claim 1, wherein the pressure receiving-side damper space and the restoring-side damper space are aligned in a radial direction.

4. The lash adjuster according to claim 3, wherein the restoring-side damper space is formed by the relay effector and the sleeve member.

5. The lash adjuster according to claim 3, wherein the oil supply passage includes a first supply and discharge passage and a second supply and discharge passage, and the working fluid is supplied to the restoring-side damper space simultaneously from the first supply and discharge passage and the second supply and discharge passage.

* * * * *